US005990796A

United States Patent [19]

Hsu

[11] Patent Number: 5,990,796

[45] Date of Patent: Nov. 23, 1999

[54] FLASH AND VOICE WARNING SYSTEM

[76] Inventor: Ching-Fu Hsu, P.O. Box 82-144, Taipei, Taiwan

[21] Appl. No.: 09/186,619

[22] Filed: Nov. 6, 1998

[51] Int. Cl.[6] ..... G08B 17/12

[52] U.S. Cl. ..... 340/577; 340/286.05; 340/331; 340/332; 340/692; 340/693.1

[58] Field of Search ..... 340/286.05, 331, 340/332, 628, 577, 578, 692, 693.1

[56] References Cited

U.S. PATENT DOCUMENTS

| | | | |
|---|---|---|---|
| 4,816,809 | 3/1989 | Kim | 340/584 |
| 4,881,058 | 11/1989 | Berry, III | 340/508 |
| 5,291,183 | 3/1994 | Chiang | 340/384.5 |
| 5,696,487 | 12/1997 | Choi | 340/331 |
| 5,724,020 | 3/1998 | Hsu | 340/331 |

*Primary Examiner*—Daniel J. Wu
*Attorney, Agent, or Firm*—A & J

[57] ABSTRACT

A flash and voice warning system generally comprises a power supply with charging circuit, a smoke sensor power supply and auto reset circuit, a smoke sensor (or manual operation), a circuit for converting current to voltage, a single-chip microprocessor, a 60 Hz square wave generator, a control circuit, a buffer, a current amplifier, a high-voltage circuit, N-discharge tube circuits, N-triggering circuits, a flash lamp direction control circuit, and a voice circuit. The smoke sensor is arranged in an appropriate position of a building and the other circuits are mounted within a control box made of fire-proof material. Hence, the flash and voice warning system for fire accidents can direct people where to flee from the fire in case of fire accidents.

1 Claim, 2 Drawing Sheets

FLASH AND VOICE WARNING SYSTEM

CROSS-REFERENCE

This invention is related to U.S. Pat. No. 5,724,020 owned by the same inventor.

BACKGROUND OF THE INVENTION

1. Field of the Invention

This invention is related to a flash and voice warning system for fire accidents.

2. Description of the Prior Art

It is often known that many people die of suffocation and flames in a building, especially a large and high building. In order to survive the toxic environment associated with fires, victims need to reach breathable air in a minute. Hence, there are known fire alarms used for giving warning signals to the people in a building. However, such alarms are simply apparatuses for giving a warning of danger and cannot tell people where to flee from the fire thereby making it impractical in use.

Therefore, it is an object of the present invention to provide a flash and voice warning system for fire accidents which can obviate and mitigate the above-mentioned drawbacks.

SUMMARY OF THE INVENTION

This invention is directed to a flash and voice warning system for fire accidents.

It is the primary object of the present invention to provide a flash and voice warning system for fire accidents which will can direct people where to flee from the fire in case of fire accidents.

It is still another object of the present invention to provide a flash and voice warning system for fire accidents which may ensure the safety of all people in a building.

It is still another object of the present invention to provide a flash and voice warning system for fire accidents which is simple in construction.

It is still another object of the present invention to provide a flash and voice warning system for fire accidents which is easy to manufacture.

It is a further object of the present invention to provide a flash and voice warning system for fire accidents which is practical in use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
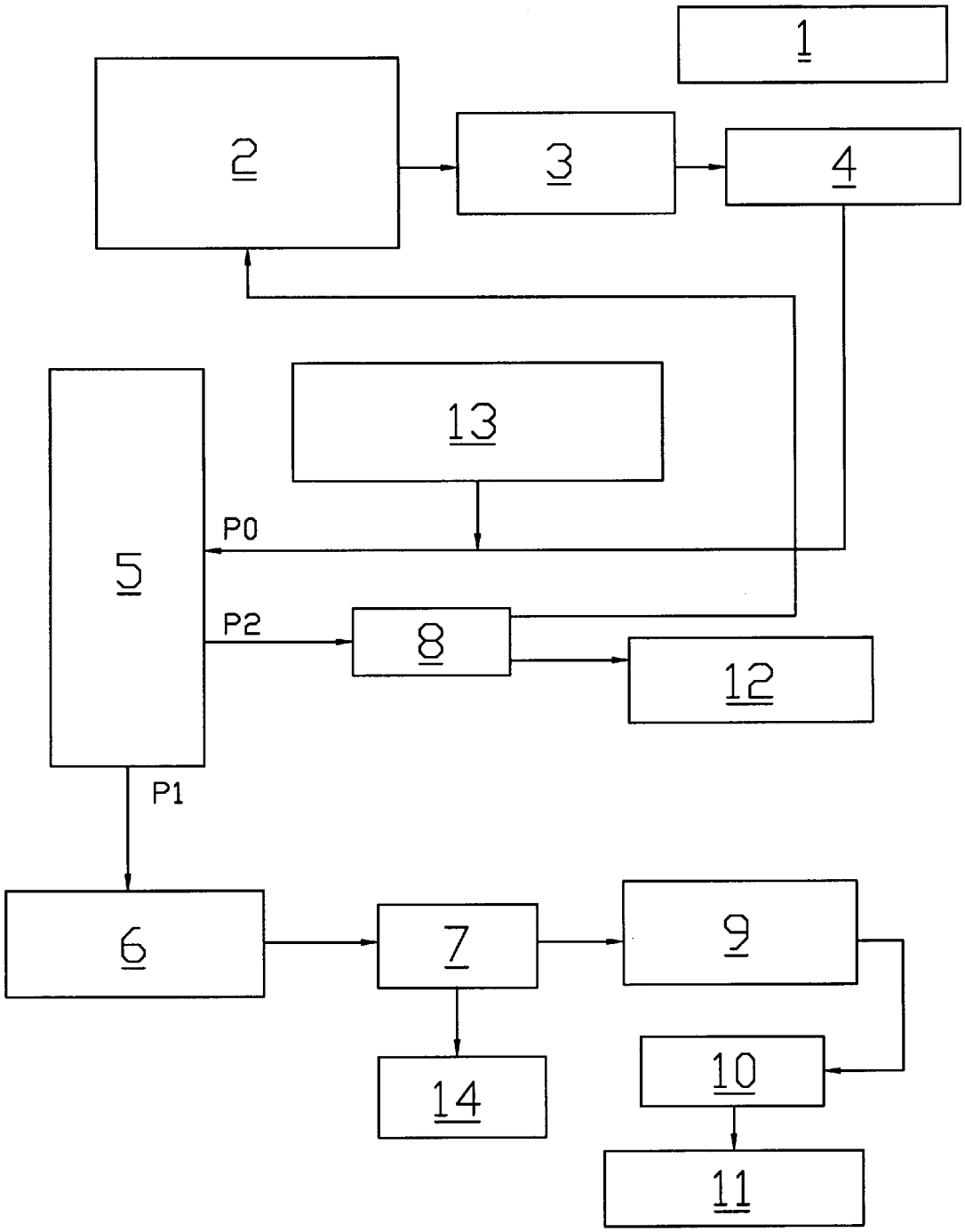
FIG. 1 is a block diagram of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
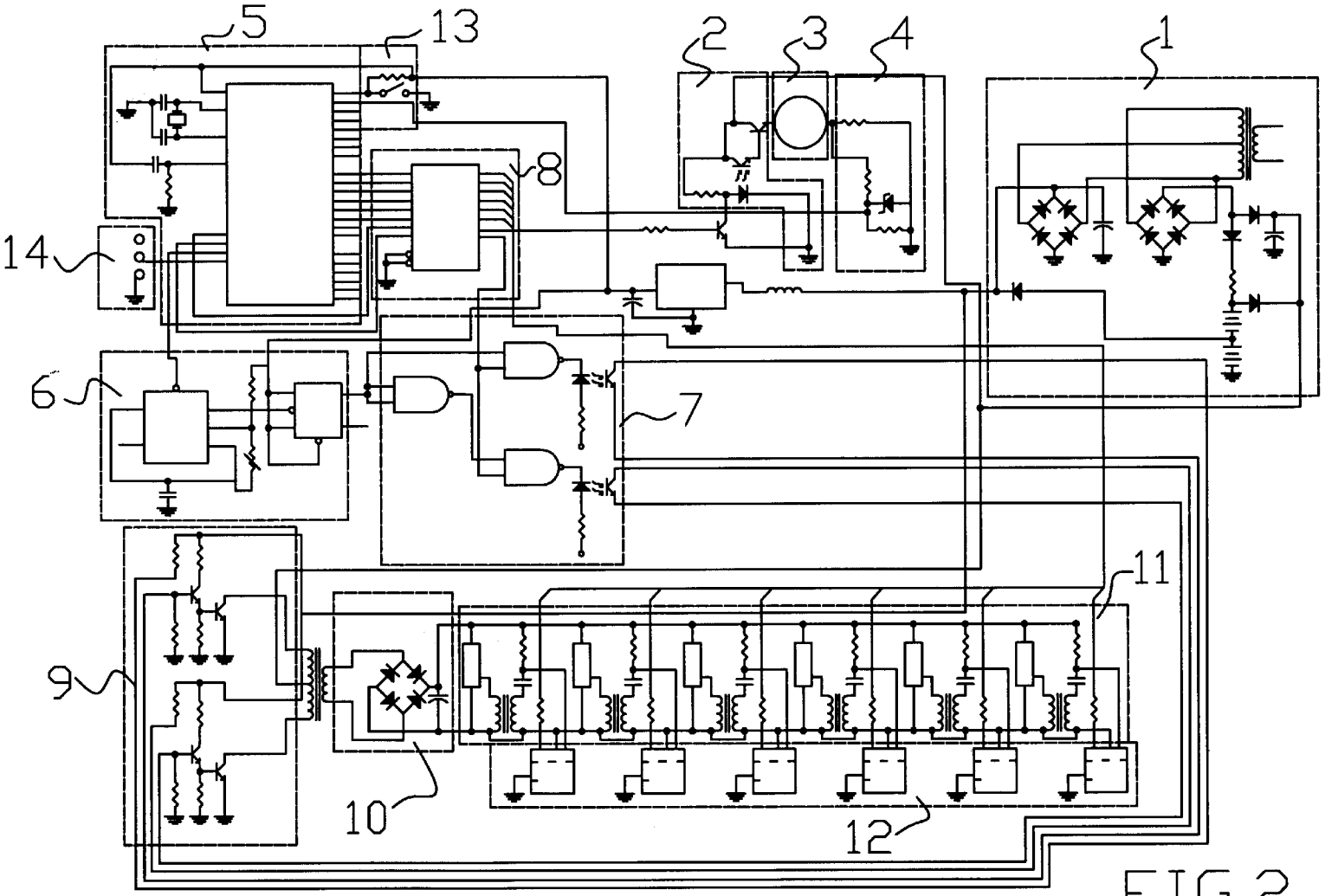
FIG. 2 is a circuit diagram of the present invention.

With reference to FIGS. 1 and 2, the flash and voice warning system according to the present invention generally comprises a power supply with charging circuit 1, a smoke sensor power supply and auto reset circuit 2, a smoke sensor (or manual operation) 3, a circuit 4 for converting current to voltage, a single-chip microprocessor 5, a 60 Hz square wave generator 6, a control circuit 7, a buffer 8, a current amplifier 9, a high-voltage circuit 10, N-discharge tube circuits 11, N-triggering circuits 12, a flash lamp direction control circuit 13, and a voice circuit 14. The smoke sensor 3 is arranged in an appropriate position of a building and the other circuits are mounted within a control box made of fire-proof material.

The functions of the component parts of the present invention will now be described hereinafter as follows:

The power supply with charging circuit 1 is used for providing 24V, 12V and 5V powers for the system and can be used for charging batteries.

If the smoke sensor power supply and auto reset circuit 2 or the smoke sensor 3 does not detect any smoke or manual operation, the circuit 4 for converting current to voltage will not produce high voltage. When the port O of the single-chip microprocessor 5 detects the circuit 4 for converting current to voltage, it will control the 60 Hz square wave generator 6 and the control circuit 7 not to work and the voice circuit 14 not to function.

If the smoke sensor (or manual operation) 3 detects smoke or is manually operated, the circuit for converting current to voltage 4 will generate a high voltage.

If the port O of the single-chip microprocessor 5 detects a high voltage generated by the circuit for converting current to voltage 4, the port 1 of the single-chip microprocessor 5 will control the 60 Hz square wave generator 6 to oscillate to generate square waves. In the meantime, the control circuit 7 transmits the square waves to the current amplifier 9.

Accordingly, 60 Hz square waves obtain sufficient current from the current amplifier 9 to drive a step-up transformer.

As the step-up transformer is driven by sufficient 60 Hz pulse current, the secondary coil of the step-up transformer will provide an alternating current of about 150V.

The alternating current of about 150V is rectified into direct current of about 400V by a bridge-rectifying and high voltage filtering circuit 10.

The direct current of about 400V is applied to two electrodes of the N discharge tubes. However, in order to cause the discharge tubes to discharge, it is necessary to trigger the gate of the discharge tube.

Then, the port 2 of the single-chip microprocessor 5 sends out pulse signals to activate the triggering circuit 12.

By means of the flash lamp direction control circuit 13, the discharging direction can be controlled thereby causing strong lamps to flash to indicate the exit direction.

If voice directions are required for illustration, the port 1 of the single-chip microprocessor 5 will be used for driving the voice circuit 14.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A flash and voice warning system comprising a power supply with charging circuit, a smoke sensor power supply and auto reset circuit, a smoke sensor (or manual operation), a circuit for converting current to voltage, a single-chip microprocessor, a 60 Hz square wave generator, a control circuit, a buffer, a current amplifier, a high-voltage circuit, N-discharge tube circuits, N-triggering circuits, a flash lamp direction control circuit, and a voice circuit, wherein:

said smoke sensor is arranged in an appropriate position of a building and other circuits are mounted within a control box made of fire-proof material;

said power supply with charging circuit is used for providing 24V, 12V and 5V powers for said system and charging batteries;

if said smoke sensor power supply and auto reset circuit or said smoke sensor does not detect any smoke or manual operation, the circuit for converting current to voltage will not produce high voltage, and when port O of said single-chip microprocessor detects no high voltage generated by said circuit for converting current to voltage, said single-chip microprocessor will control said 60 Hz square wave generator and said control circuit not to work and said voice circuit not to function;

if said smoke sensor (or manual operation) detects smoke or is manually operated, said circuit for converting current to voltage will generate a high voltage;

if said port O of said single-chip microprocessor detects a high voltage generated by said circuit for converting current to voltage, port 1 of said single-chip microprocessor will control said 60 Hz square wave generator to oscillate to generate square waves, and meanwhile, said control circuit transmits said square waves to said current amplifier;

accordingly, said 60 Hz square waves obtain sufficient current from said current amplifier to drive a step-up transformer;

as said step-up transformer is driven by sufficient 60 Hz pulse current, a secondary coil of said step-up transformer will provide an alternating current of about 150V;

said alternating current of about 150V is rectified into direct current of about 400V by a bridge-rectifying and high voltage filtering circuit;

said direct current of about 400V is applied to two electrodes of said N discharge tubes;

a port 2 of said single-chip microprocessor sends out pulse signals to activate said triggering circuit;

by means of said flash lamp direction control circuit, said discharging direction can be controlled thereby causing emergency lamps to flash to indicate an exit direction; and if voice directions are required for illustration, said port 1 of said single-chip microprocessor is used for driving said voice circuit.

* * * * *